US008083560B2

(12) United States Patent
Foulke

(10) Patent No.: US 8,083,560 B2
(45) Date of Patent: Dec. 27, 2011

(54) PIVOTAL SURFBOARD FIN ASSEMBLY

(76) Inventor: Robert W. Foulke, San Clemente, CA (US)

( * ) Notice: Subject to any disclaimer, the term of this patent is extended or adjusted under 35 U.S.C. 154(b) by 383 days.

(21) Appl. No.: 12/479,666

(22) Filed: Jun. 5, 2009

(65) Prior Publication Data

US 2010/0311294 A1 Dec. 9, 2010

(51) Int. Cl.
*B63B 35/79* (2006.01)
*B63B 41/00* (2006.01)

(52) U.S. Cl. ..... 441/79

(58) Field of Classification Search ..... 114/39.12, 114/39.15, 127, 132, 140, 152; 441/74, 79
See application file for complete search history.

(56) References Cited

U.S. PATENT DOCUMENTS

| | | | | |
|---|---|---|---|---|
| 3,890,661 | A * | 6/1975 | Johnson | 441/79 |
| 4,325,154 | A | 4/1982 | Collum, Jr. | |
| 4,701,144 | A | 10/1987 | DeWitt, III | |
| 4,733,496 | A | 3/1988 | Wallner | |
| 4,854,904 | A * | 8/1989 | Wahl | 441/79 |
| 5,273,472 | A | 12/1993 | Skedeleski et al. | |
| 5,480,331 | A | 1/1996 | Lewis | |
| 5,649,846 | A | 7/1997 | Harper et al. | |
| 5,664,979 | A | 9/1997 | Benham | |
| 5,813,890 | A | 9/1998 | Benham | |
| 5,934,962 | A | 8/1999 | Daum et al. | |
| 5,934,963 | A | 8/1999 | Frizzell | |
| 6,053,789 | A | 4/2000 | Miyahsiro | |
| 6,439,940 | B1 | 8/2002 | Pouchkarev | |
| 6,991,504 | B1 | 1/2006 | English et al. | |
| 7,001,236 | B2 | 2/2006 | Blake, Jr. | |
| 7,108,571 | B2 | 9/2006 | Geraghty | |
| 7,182,661 | B2 | 2/2007 | Sams et al. | |
| 7,481,690 | B2 | 1/2009 | Shibata | |
| 2002/0094733 | A1 | 7/2002 | Kershaw | |
| 2005/0064775 | A1 | 3/2005 | White | |
| 2006/0035543 | A1 | 2/2006 | English et al. | |
| 2006/0189230 | A1 | 8/2006 | Sams et al. | |
| 2007/0202760 | A1 | 8/2007 | Caldwell et al. | |
| 2007/0259579 | A1 | 11/2007 | Schmidt | |
| 2008/0050994 | A1 | 2/2008 | Shibata | |
| 2008/0268730 | A1 | 10/2008 | Heesterman | |

* cited by examiner

*Primary Examiner* — Ajay Vasudeva
(74) *Attorney, Agent, or Firm* — Stetina Brunda Garred & Brucker

(57) ABSTRACT

A pivotal surfboard fin assembly for use on a surfboard, the assembly comprising: an insert bracket having a board face mountable to the bottom surface of the surfboard and a bracket face with a lock pin aperture and a flex plug cavity; an elastomeric flex plug having a flex plug hole, a first flex plug surface, and a second flex plug surface, the flex plug disposed in the flex plug cavity; a surfboard fin having a fin blade, a mounting edge, a flex pin channel, a fixed lock pin mountable to the surfboard fin and disposable into the lock pin aperture, a biased flex pin slidably disposable into the flex pin channel and the flex plug hole; and a first compression pin and a second compression pin engaged with the insert bracket and operative to laterally compress the flex plug.

16 Claims, 6 Drawing Sheets

PIVOTAL SURFBOARD FIN ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a pivotal surfboard fin assembly for use on a surfboard.

Surfing requires a high level of adaptability to weather, tide, wave and other environmental conditions to a degree not found in most other sports. As with the weather, surf conditions can be somewhat difficult to precisely predict and are dynamic, requiring the surfing enthusiast be prepared for a wide range of wave conditions. A change in the size, direction, break, interval, and shape of waves necessitates that a surfer have access to surfing equipment adaptable to the dynamic state of wave conditions.

Of particular importance is the adaptability of the surfboard scags or fins to the predominating wave conditions at any given time. Depending on the characteristics of a wave, a surfer may want their surfboard to have either increased or decreased maneuverability on the face of a wave. This may be achieved by either increasing or decreasing the level of resistance the fin blades on a surfboard have to water forces. For example, on a larger wave with less shape, a surfer may prefer less maneuverability across the face of a wave, thereby requiring a fin that is more resistant to the water forces acting on the fin blade. When waves are perhaps smaller in size but have better shape, a surfer may require a surfboard with a fin blade having greater flexibility and therefore less resistance to water forces acting on the fin blade, thereby enabling the surfboard to alter direction quicker on a shorter turning radius. A surfboard fin assembly that is able to quickly and efficiently adjust the pivot of the surfboard fin may be useful for surfers desiring to be prepared for and able to adapt to ever changing wave conditions.

There are a number of surfboard fin assemblies that attempt to adjust the level of pivot of the surfboard fin in response to wave conditions, depending on the desired level of maneuverability. Many of these assemblies do not appear to be intended for use on surfboards, but rather appear to be intended for other water craft. Some of these prior art fin assemblies appear to allow a limited range for the pivoting of the surfboard fin, but do not enable the surfboard fin to not have any pivotal movement. Also, many of these prior art assemblies appear to be disposed in the interior of the fin blade, thereby encumbering access to the pivoting mechanism for adjustment of the surfboard fin's pivot. It is also understood that these prior art assemblies generally allow adjustment of the surfboard fin's pivot, but they do not appear to allow for the precise adjustment of the fin blade's pivot within a narrow range of motion.

For instance, U.S. Pat. No. 6,053,789 is understood to disclose a surfboard fin pivoting mechanism having a surfboard fin divided into two sections, an upper stationary mounting portion and a lower pivoting fin, with a rotational pivoting mechanism located in a recessed area in the leading edge of the lower pivoting fin. The pivoting mechanism is comprised of an upper and lower plate, with two pins located in the lower plate projecting into two cavities spaced in the upper plate, the range of motion being set by the boundaries of the cavities serving as a stop to prevent further pivot by the lower plate pins. A center stem projecting into the upper stationary mounting portion of the fin and a center stem projecting into the lower pivoting fin positions the pivoting mechanism. The lower plate pins project into the upper plate cavity and enable pivoting about the vertical axis of these lower plate pins. In another embodiment, it is understood that the pivoting mechanism appears to be located entirely in a base positioned in the surfboard with a cavity whose dimensions again determine the boundaries for pivotal range of motion. Two winged stops project into this cavity whose rotation about a vertical axis enables pivotal movement of the surfboard fin. Neither of these embodiments appear to provide for a surfboard fin having no pivotal range of motion. Furthermore, neither of these assemblies appear to have a pivoting mechanism that is readily accessible, thereby making the adjustment process more time consuming and less efficient. Finally, it is understood that both of these embodiments appear to allow the surfboard fin to pivot within a specific range of degrees determined by the dimensions of the prefabricated cavities. However, if a "fine-tuned" and precise pivotal range of motion is desired within a narrower range of motion, these embodiments do not appear to satisfy that objective.

It is understood that U.S. Pat. No. 4,733,496 discloses a pivoting surfboard fin intended for all types of water craft, allegedly including surfboards, that include a fixed blade portion attaching to the "vessel." Two pivot pins located between the fixed blade and the pivot fin enable rotation about a vertical axis. A third foil pin positioned above a spring and a single threaded rod with an accompanying threaded thumbwheel provide a vertical stop mechanism. Precision adjustment of the pivoting mechanism in this fin blade assembly does not appear possible, particularly when used on a surfboard. In fact, it does not appear that the pivoting mechanism, fixed blade, and pivot fin aspects of the assembly would be suitable for use on a surfboard, in light of the splitting of the fin blade, the location of the pivoting mechanism, and the dimensions of the depicted assembly.

It is understood that U.S. Pat. No. 5,813,890 discloses a pivoting fin with elastic bias assembly for mounting to the lower surface of a watercraft hull. In one embodiment, a rectangular base is connected by hinge pins to a fin. This assembly appears to have a stop mechanism consisting of side springs and side shoulders that limit the pivot range of motion. Pivotal rotation appears to occur about a horizontal axis between the base and fin. The pivoting mechanism is located between a fixed fin portion extending from the mounting base and a pivoting fin section pivotally hinged to the fixed fin. The pivoting fin appears to contain a pair of tabs projecting into slots located in the fixed fin portion with shoulders located on the pivoting fin serving to limit the degree of pivot. These shoulders appear to be comprised of opposing springs whose resistance to pivot is determined by the spring material or spring constant, with a stiffer spring rendering the surfboard more stiff. In another embodiment, an insert comprised of a pair of wings provides the pivoting mechanism. The insert is disposed in a cavity between the pivot fin and the base. The stiffness of the hinge appears to be determined by the thickness of the insert. As in the prior embodiment, the pivot axis runs horizontally along a hinge pin located in a bore spanning the pivot fin, elastomeric member, and base. Side shoulders serve as stop members to limit the pivot of the pin. It does not appear that this surfboard fin assembly may be configured such that all pivoting is disabled. Furthermore, the pivot range of motion appears to be determined by either the spring material or shoulders positioned adjacent to the pivot mechanism. It is understood that neither of these elements is able to precisely control the degree of pivot within a narrow range of motion. Finally, this prior art pivot fin assembly does not appear to be specifically intended for use on a surfboard, nor does it appear to readily enable the adjustment of the pivoting mechanism.

Accordingly, there appears to be a need in the art for a new surfboard fin assembly intended specifically for surfboards that are able to accommodate all types of surfboard fins with a readily accessible and precisely adjustable pivoting mechanism that enables adjustment of the pivot of the fin blade within a narrow range.

BRIEF SUMMARY

According to an aspect of the present invention, there is provided a pivotal surfboard fin assembly for use with a surfboard, the surfboard having a top surface and a bottom surface. The assembly comprises an insert bracket defining a longitudinal bracket axis and a lateral bracket axis disposed perpendicular to the longitudinal bracket axis. The insert bracket has a board face mountable to the bottom surface of the surfboard and a bracket face opposite the board face. The bracket face may have a lock pin aperture defining a generally longitudinal lock pin axis and a flex plug cavity. The surfboard fin assembly further has an elastomeric flex plug having a flex plug hole defining a generally longitudinal flex plug axis. The elastomeric flex plug further has a first flex plug surface and an opposing second flex plug surface. The flex plug is disposed in the flex plug cavity. The surfboard fin assembly further has a surfboard fin having a fin blade, a mounting edge, and a flex pin channel defining a generally longitudinal flex pin axis extending from the interior of the fin blade to the mounting edge. The surfboard fin further has a fixed lock pin having a lock pin first end mountable to the mounting edge and a lock pin second end sized and configured to be rotatably and slidably disposable into the lock pin aperture. The surfboard fin further has a biased flex pin proximate to the lock pin with a flex pin first end sized and configured to be slidably disposable into the flex pin channel. The flex pin further has a flex pin second end sized and configured to be slidably disposable into the flex plug hole with the insertion of the lock pin second end into the lock pin aperture, thereby enabling the fin blade to pivot on the bottom surface of the surfboard. The surfboard fin assembly further has a first compression pin and a second compression pin. The first compression pin has a first compression pin first end engaged with the insert bracket and a first compression pin second end sized and configured to compress the first flex plug surface along a generally lateral first compression pin axis, with the flex pin second end disposed in the flex plug hole. The first compression pin axis is generally orthogonal to the flex plug. The second compression pin has a second compression pin first end engaged with the insert bracket and a second compression pin second end sized and configured to compress the second flex plug surface along a generally lateral second compression pin axis with the flex pin second end disposed in the flex plug hole. The second compression pin axis may be generally orthogonal to the flex plug.

The pivotal surfboard fin assembly is innovative in that the pivoting mechanism of the flex plug, the first compression pin, and the second compression pin are readily accessible for adjustment at the bracket face of the insert bracket. Accordingly, a surfer may respond to wave conditions quickly and efficiently by making adjustments to the degree of compression of the first compression pin and the second compression pin against the flex plug with the flex pin second end disposed in the flex plug hole. Furthermore, as most surfboard fins have a mounting edge to which a fixed lock pin and a flex pin may be disposed, and all surfboards have a bottom surface to which an insert bracket may be mounted, the pivot surfboard fin assembly is further innovative in that it may be sized and configured for the mounting of most surfboard fins on most surfboards. Additionally, the configuration of the surfboard fin assembly having the first compression pin and the second compression pin able to independently compress the flex plug with varying degrees of force is innovative, as the range of motion in the pivot of the fin blade may be customized within a narrow range, thereby enabling the adjustment of the pivot of the fin blade with precision. This feature enables a surfer to precisely adjust the pivot of the surfboard fin to adapt to prevailing wave conditions. Should further adjustments be necessary, the pivotal surfboard fin assembly is innovative in that fine-tuning of the fin blade's pivot can be readily achieved, thereby reducing the amount of time and effort devoted to modifying the pivot of the surfboard fin. The absence of cumbersome and recessed parts hidden in the fin blade or base enables convenient access to the bracket face of the insert bracket to make adjustments to the surfboard fin's pivot as needed.

None of the prior art surfboard fin assemblies appear to utilize a pivoting mechanism intended specifically for surfboards comprising the insertion of a fixed lock pin into an insert bracket and a second flex pin into an elastomeric flex plug, the compression of which by two compression pins along lateral axes operates to precisely control the amount of pivot in the fin blade on the bottom of a surfboard. The pivoting mechanisms in the prior art surfboard fin assemblies appear to provide a broad range of movement of the surfboard fin as opposed to precisely controlling the level of pivot within a narrow range. The pivoting mechanism in the prior art surfboard fin assemblies appear more difficult to access, thereby causing the surfer to expend more time and effort adjusting the surfboard pivot. By the time adjustments are made on these prior art assemblies, prevailing wave conditions may have changed such that further modifications may be needed. Many of the prior art surfboard fin assemblies also appear to be intended for use on a variety of different types of watercraft, whose hidden pivoting mechanisms and cumbersome fin blade configurations do not appear well adapted for use specifically on surfboards.

In another embodiment of the present invention, the insert bracket may be round.

According to other embodiments, the flex plug may be made of rubber.

The pivotal surfboard fin assembly is further innovative in that the use of such materials enables the flex plug in combination with the first compression pin and the second compression pin to be compressed along a lateral axis in an amount that specifically correlates with the precise amount of pivot desired by the surfer. Insertion of the lock pin into the lock pin aperture and the flex pin into the flex plug hole along longitudinal axes in combination with the compression of the flex plug surrounding the flex pin along lateral axes uniquely enables a surfer to precisely adjust the amount of desired pivot in the surfboard's fin blade.

In another embodiment, the flex plug may be cylindrical. Alternatively, in another embodiment, the flex plug may be polygonal.

In yet a further embodiment, the bracket face of the insert bracket may include a first thumbwheel groove and a second thumbwheel groove generally opposing the first thumbwheel groove. In this embodiment the flex plug cavity may be disposed proximate to and in communication with the first thumbwheel groove through a first thumbwheel channel. The flex plug cavity may further be disposed proximate to and in communication with the second thumbwheel groove through a second thumbwheel channel. The first flex plug surface may face the first thumbwheel channel and the second flex plug surface may face the second thumbwheel channel. The bracket face may further include a first compression pin channel extending to and in communication with the first thumbwheel groove. The first compression pin first end may be disposed in the first compression channel. The bracket face may further include a second compression pin channel extending to and in communication with the second thumbwheel groove. The second compression pin first end may be disposed in the second compression channel.

In a further embodiment, the surfboard fin assembly further includes a first thumbwheel disposed in the first thumbwheel groove. The first thumbwheel may have a threaded first thumbwheel aperture. The surfboard fin assembly may further include a threaded first compression pin stem between the first compression pin first end and the first compression pin second end disposed through the first thumbwheel aperture. The first thumbwheel upon rotation may be operative to laterally move the first compression pin through the first thumbwheel channel with the first compression pin second end compressing the first flex plug surface along the first compression pin axis, thereby adjusting the pivot of the surfboard fin. Likewise, a surfboard fin assembly may further include a second thumbwheel disposed in the second thumbwheel groove. A second thumbwheel may have a threaded second thumbwheel aperture. The assembly may further include a threaded second compression pin stem between the second compression pin first end and the second compression pin second end disposed through the second thumbwheel aperture. The second thumbwheel upon rotation may be operative to laterally move the second compression pin through the second thumbwheel channel with the second compression pin second end compressing the second flex plug surface along the second compression pin axis, thereby adjusting the pivot of the surfboard fin.

In this regard, the pivotal surfboard fin assembly is further innovative in that it uniquely enables the pivoting mechanism of the flex plug in combination with the flex pin, the first compression fin and the second compression pin to be efficiently and readily adjusted by the first thumbwheel and second thumbwheel configuration. The independent operation of the first thumbwheel from the second thumbwheel enables the surfer to customize the amount of compression by each of the first compression pin and the second compression pin against the flex plug. For example, if less resistance to water forces is desired on one side of the surfboard fin blade, the compression pin on the surface of the flex plug corresponding to that side may be loosened in comparison to the compression pin on the opposing side of the flex plug, thereby allowing a precise amount of pivot desired for each side of the fin blade, depending on the wave conditions and the surfer's desired maneuverability and anticipated direction of travel along the face of a wave.

According to other embodiments, the surfboard fin assembly further includes a first flex plug surface aperture on the first flex plug surface and an opposing second flex plug surface aperture on the second flex plug surface. In this embodiment, the first compression pin second end may be movable through the first flex plug surface aperture by rotation of the first thumbwheel operative to compress the flex plug and the flex pin along the first compression pin axis. The second compression pin second end may be disposable through the second flex plug surface aperture by rotation of the second thumbwheel operative to compress the flex plug and the flex pin along the second compression pin axis, thereby adjusting the pivot of the surfboard fin.

This feature uniquely enables the first compression pin and the second compression pin to adjust the amount of compression along lateral axes proximate to the flex pin, which is longitudinally disposed in the flex plug hole. The first flex plug surface aperture and the second flex plug surface aperture uniquely enable the first compression pin and the second compression pin to be in close proximity to the flex pin. This configuration enables a precise adjustment of the amount of movement or pivot of the flex pin, thereby controlling the specific amount of pivot afforded to the surfboard fin blade along the first compression pin axis and the second compression pin axis.

In a further embodiment of the present invention, the first compression pin first end may be beveled. In another embodiment, the second compression pin first end may also be beveled.

In yet a further embodiment, the lock pin second end may have a lock pin cam head for rotatably engaging a lock pin plate mounted to the distal end of the lock pin aperture. This feature uniquely enables the lock pin second end to be rotatably and slidably disposed into the lock pin aperture of the insert bracket by a "twist and insert" motion.

Another embodiment of the present invention further includes a biased flex pin spring disposed in the distal end of the flex pin channel adjacent to the flex pin first end. The flex pin spring may be operative to release the flex pin second end along the flex plug axis into the flex plug hole with the insertion of the lock pin second end into the lock pin aperture.

This feature uniquely extends the flex pin second end by way of a biased spring into the flex plug hole, with the flex pin released into the flex pin hole by the spring action of the flex pin spring.

According to another embodiment, the pivotal surfboard fin assembly may further include a flex pin lever on the flex pin operative to extend the flex pin second end along the flex plug axis into the flex plug hole. The flex pin lever may be extendable through a lever aperture proximate to the flex pin channel on the fin blade. The lever aperture may have a lever notch operative to position the flex pin lever, with the flex pin lever above the lever notch with the flex pin retracted into the flex pin channel and the flex pin lever below the lever notch with the flex pin extended into the flex plug channel.

In another embodiment, the surfboard fin assembly may further include an insert bracket seal operative to cover the insert bracket.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The drawings referred to herein are for the purposes of illustrating the preferred embodiments of the present invention and not for the purposes of limiting the same.

Figure 1:
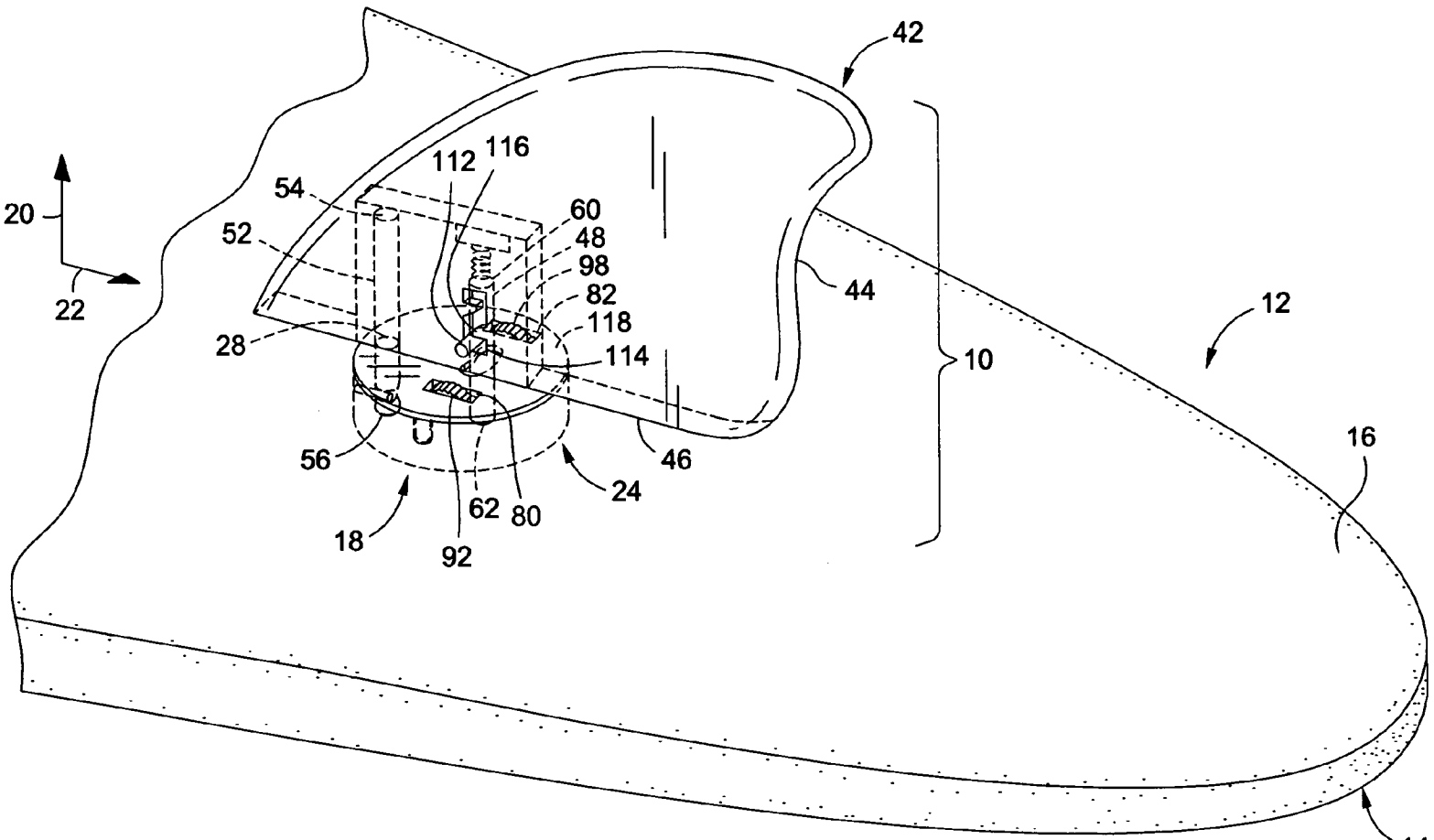
FIG. 1 is a perspective view of the surfboard fin assembly on the bottom surface of the surfboard, showing the engagement of the surfboard fin onto the insert bracket along the longitudinal lock pin axis and a longitudinal flex pin axis.
Figure 2:
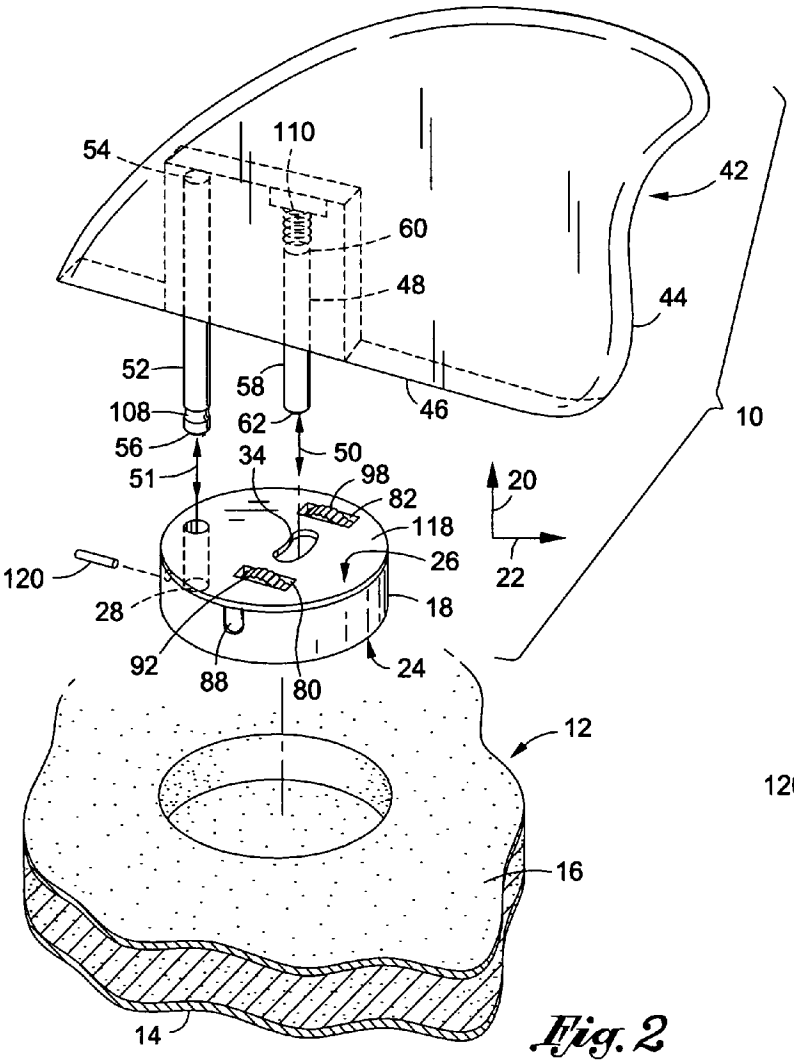
FIG. 2 is an exploded top view of an embodiment of the pivotal surfboard fin assembly showing the insertion of the lock pin into the lock pin aperture and the flex pin into the flex plug hole, the first thumbwheel and the second thumbwheel, as well as the mounting of the insert bracket into the bottom surface of the surfboard.

FIGS. 1 and 2 are an embodiment of the pivotal surfboard fin assembly 10 depicting a surfboard 12 having a top surface 14 and a bottom surface 16.

An insert bracket 18 is shown mounted to the bottom surface 16 of the surfboard 12. The insert bracket 18 has a longitudinal bracket axis 20 and a lateral bracket axis 22. The insert bracket 18 further has a board face 24 and a bracket face 26 opposing the board face 24. With the insert bracket 18 mounted to the surfboard, the board face 24 faces the bottom surface 16 of the surfboard 12. The bracket face 26 has a lock pin aperture 28 and a flex plug cavity 30.

FIGS. 1 and 2 illustrate the insert bracket 18 having a round configuration. However, it is also contemplated within the scope of the present invention that the insert bracket 18 may have a different configuration, such as rectangle, triangle, square, oval or the like suitably mounted to the bottom surface 16 of the surfboard 12.

Figure 3:
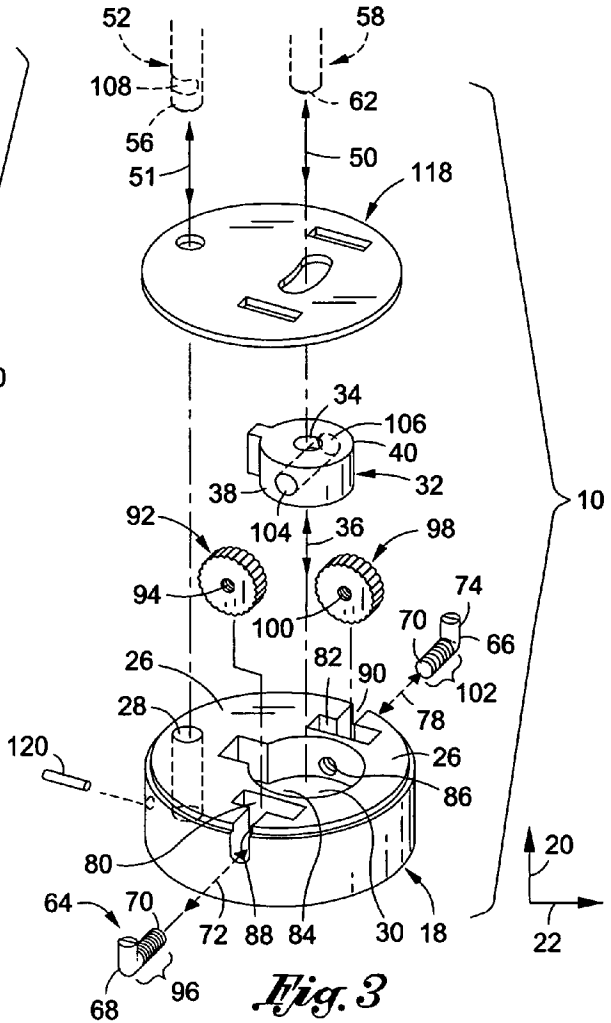
FIG. 3 is a perspective view of an embodiment of the pivotal surfboard fin assembly showing the manner in which the lock pin is inserted into the lock pin aperture and the flex pin is inserted into the flex plug hole of the flex plug, as well as the insertion of the flex plug into the flex plug cavity of the insert bracket, and the configuration of the threaded first compression pin and the threaded second compression pin into the first thumbwheel aperture and the threaded second thumbwheel aperture for adjusting the amount of pivot of the flex plug.

Referring now to FIG. 3, an embodiment of the surfboard fin assembly 10 may further include an elastomeric flex plug 32 having a flex plug hole 34 defining a longitudinal flex plug axis 36. The flex plug 32 may be made of any elastomeric material, including but not limited to rubber. Although the flex plug 32 depicted in FIG. 3 is cylindrical, it is also contemplated within the scope of the present invention that the various aspects of the surfboard fin assembly 10 may be employed with a flex plug 32 that has a polygonal, square, or other configuration. The flex plug 32 may have a first flex plug surface 38 and a second flex plug surface 40. The flex plug 32 is disposed in the flex plug cavity 30 on the bracket face 26 of the insert bracket 18. In the embodiment depicted in FIG. 3, the first flex plug surface 38 may be positioned facing a first thumbwheel channel 84. The second flex plug surface 40 may be positioned facing a second thumbwheel channel 86.

The embodiment of the surfboard fin assembly 10 depicted in FIGS. 1 and 2 also shows a surfboard fin 42 having a fin blade 44 and a mounting edge 46 along which the surfboard fin 42 is disposable into the bracket face 26 of the insert bracket 18. The surfboard fin 42 also has a flex pin channel 48 defining a generally longitudinal flex pin axis 50 extending from the interior of the fin blade 44 to the mounting edge 46.

This embodiment of the surfboard fin assembly 10 has a biased flex pin 58 having a flex pin first end 60 and a flex pin second end 62. The flex pin first end 60 is sized and configured to be slidably disposable into the flex pin channel 48 along the longitudinal flex pin axis 50. The surfboard fin 42 also has a fixed lock pin 52 having a lock pin first end 54 and a lock pin second end 56. The lock pin first end 54 is shown in FIG. 1 is mounted to the mounting edge 46 of the surfboard fin 42. The lock pin second end is sized and configured to be rotatably and slidably disposed into a lock pin aperture 28 along a generally longitudinal lock pin axis 51. The lock pin 52 is fixedly mounted to the surfboard fin 42. Although the lock pin first end 54 depicted in FIG. 1 is shown to be mounted through the mounting edge 46 and into the interior of the fin blade 44, it is also contemplated that in other embodiments of the surfboard fin assembly 10, the lock pin 52 may be fixedly mounted to the surfboard fin 42 at the mounting edge 46 without extending into the fin blade 44. Once the lock pin second end 56 has been rotatably and slidably inserted into the lock pin aperture 28, the biased flex pin 58 may be released along the longitudinal flex pin axis 50 into the flex plug hole 34 of the flex plug 32. In the embodiment depicted in FIG. 1, the flex pin 58 is biased for release along the flex pin axis into the flex plug hole 34 by a flex pin lever 112 on the flex pin 58. The flex pin lever 112 is operative to release the flex pin second end 62 along the longitudinal flex plug axis 36 and the flex pin axis 50 into the flex plug hole 34. The flex pin lever 112 is depicted in FIG. 1 to extend through a lever aperture 114 on the fin blade 44 proximate to the flex pin channel 48. A lever notch 116 on the lever aperture 114 is operative to position the flex pin lever 112 such that the flex pin 58 may be retracted into the flex pin channel 48 with the flex pin lever 112 positioned above the lever notch 116. The flex pin may be released and extended into the flex plug hole 34 with the flex pin lever 112 moved into a position below the lever notch 116.

Referring now to FIG. 2, in an alternative embodiment, the flex pin 58 is biased toward the flex plug hole by a flex pin spring 110 disposed in the distal end of the flex pin channel 48 in the fin blade 44. In this embodiment, the flex pin first end 60 is adjacent to the flex pin spring 110. The flex pin spring 110 is operative to release the flex pin second end 62 along the longitudinal flex plug axis 36 and the flex pin axis 50 into the flex plug hole 34, once the lock pin second end 56 has been rotatably and slidably disposed into the lock pin aperture 28.

Referring again to FIG. 3, an embodiment of the surfboard fin assembly 10 may further include a first compression pin 64 and a second compression pin 66. The first compression pin 64 may include a first compression pin first end 68 engaged with the insert bracket 18. In the embodiment in FIG. 3, the first compression pin first end 68 is shown to be sized and configured to be disposed into a first compression pin channel 88 that extends to a first thumbwheel groove 80. A first compression pin second end 70 is shown to be sized and configured to extend through the first thumbwheel channel 84 along a first compression pin axis 72 that is generally orthogonal to the flex plug 32. In the embodiment shown in FIG. 3, the first compression pin 64 further includes a threaded first compression pin stem 96 that is sized and configured to be disposed through a threaded first thumbwheel aperture 94 on a first thumbwheel 92 disposed in the first thumbwheel groove 80. The threaded first thumbwheel aperture 94 may have right-handed or left-handed threads. Upon rotation of the first thumbwheel 92, the first compression pin 64 may be moved along the generally lateral first compression pin axis 72 through the first thumbwheel channel 84. With the flex plug 32 disposed in the flex plug cavity 30, the first compression pin second end 70 may apply lateral compression forces to the first flex plug surface 38 along the first compression pin axis 72. This uniquely enables the adjustment of the pivot of the fin blade 44 upon the insertion of the surfboard fin 42 into the lock pin aperture 28 and the flex plug 32 on the insert bracket 18.

FIG. 3 further depicts an embodiment of the surfboard fin assembly 10 with the second compression pin 66, including a second compression pin first end 74 engaged with the insert bracket 18. In the embodiment in FIG. 3, the second compression pin first end 74 is sized and configured to be disposed into a second compression pin channel 90 that extends to a second thumbwheel groove 82. A second compression pin second end 76 is shown to be sized and configured to extend through the second thumbwheel channel 86 along a second compression pin axis 78 that is generally orthogonal to the flex plug 32. In the embodiment shown in FIG. 3, the second compression pin 66 further includes a threaded second compression pin stem 102 that is sized and configured to be disposed through a threaded second thumbwheel aperture 100 on a second thumbwheel 98 disposed in the second thumbwheel groove 82. The threaded second thumbwheel aperture 100 have right-handed or left-handed threads. Upon rotation of the second thumbwheel 98, the second compression pin 66 may be moved along the generally lateral second compression pin axis 78 through the second thumbwheel channel 86. With the flex plug 32 disposed in the flex plug cavity 30, the second compression pin second end 76 may apply lateral compression forces to the second flex plug surface 40 along the second compression pin axis 78. This uniquely enables the adjustment of the pivot of the fin blade 44 upon the insertion of the surfboard fin 42 into the lock pin aperture 28 and the flex plug 32 on the insert bracket 18.

Now referring to FIGS. 1-3, the configuration of the insertion of the fixed lock pin 52 into the lock pin aperture 28 along the longitudinal lock pin axis 51, and the insertion of the flex pin 58 into the flex plug hole 34 of the flex plug 32 along the longitudinal flex pin axis 50, in combination with the lateral compression forces by the first compression pin 64 and the second compression pin 66 on the flex plug 32 is innovative and may be particularly well adapted to facilitating the precise adjustment of the amount of pivot desired in the fin blade 44 of the surfboard 12. As discussed above, the pivoting mechanism of the surfboard fin assembly 10, including the flex plug 32, the first compression pin 64, and the second compression pin 66 may be readily adjusted at the bracket face 26 of the insert bracket 18. In the embodiment depicted in FIG. 3, this adjustment may be readily achieved by rotation of the first thumbwheel 92 and/or the second thumbwheel 98. This configuration enables a surfer to respond to wave conditions quickly and efficiently by making adjustments to the amount of compression forces applied by the first compression pin 64 and the second compression pin 66 on the flex plug 32. The independent operation of the first thumbwheel 92 and the second thumbwheel 98 enables the surfer to customize the amount of lateral compression by each of the first compression pin 64 and the second compression pin 66 against the flex plug 32. For example, if less resistance to water forces is desired when turning the surfboard 12 in a direction toward the right on the face of a wave, the first compression pin 64 which controls the lateral compression forces along the first compression pin axis 72 on the left side of the fin blade 44 may be reduced in comparison to the amount of compression forces applied by the second compression pin 66 on the surface of the flex plug 32. Conversely, the amount of lateral compression forces applied by the second compression pin 66 along the second compression pin axis 78 may be equilibrated to be less than, equal to, or exceed the compression forces applied on the flex plug 32 by the first compression pin 64, depending on the prevailing wave conditions and desired maneuverability of the surfboard 12.

The surfboard fin assembly 10 is further innovative in that almost all surfboard fins 42 have a mounting edge 46 to which a fixed lock pin 52 and flex pin 58 may be disposed. Furthermore, virtually all surfboards 12 have a bottom surface 16 to which the insert bracket 18 may be mounted. Therefore, the surfboard fin assembly 10 of the present invention is further innovative in that it may be sized and configured for mounting by most surfboard fins 42 on most if not all surfboards 12.

The configuration of the surfboard fin assembly 12 uniquely enables the fine-tuned adjustment of the range of motion in the pivot of the fin blade 44 within a narrow range, thereby enabling the more precise setting of the pivot of the fin blade 44 to prevailing wave conditions or desired performance levels. Should further adjustments be necessary, the surfboard fin assembly 10 enables ready access to the pivoting mechanism, thereby reducing the amount of time and effort devoted to modifying the pivot of the surfboard fin 42.

Referring again to FIG. 3, an embodiment of the surfboard fin assembly 10 may further include a first flex plug surface aperture 104 on the first flex plug surface 38 and an opposing second flex plug surface aperture 106 on the second flex plug surface 40. With the flex pin 58 disposed in the flex plug hole 34, the first compression pin second end 70 may be moveable through the first flex plug surface aperture 104 by rotation of the first thumbwheel 92 by applying lateral compression forces on both the flex plug 32 and the flex pin 58 along the first compression pin axis 72. In this embodiment, the second compression pin second end 76 may likewise be disposable through the second flex plug surface aperture 106 by rotation of the second thumbwheel 98, thereby applying lateral compression forces to both the flex plug 32 and the flex pin 58 along the second compression pin axis 78. With the close proximity of the first compression pin second end 70 and the second compression pin second end 76 to the flex pin 58, this configuration enables an even more precise adjustment of the amount of movement or pivot of the flex pin 58. This in turn enables the surfer to control the specific amount of pivot afforded to the surfboard fin blade 44 along the first compression pin axis 72 and the second compression pin axis 78.

Figure 4:
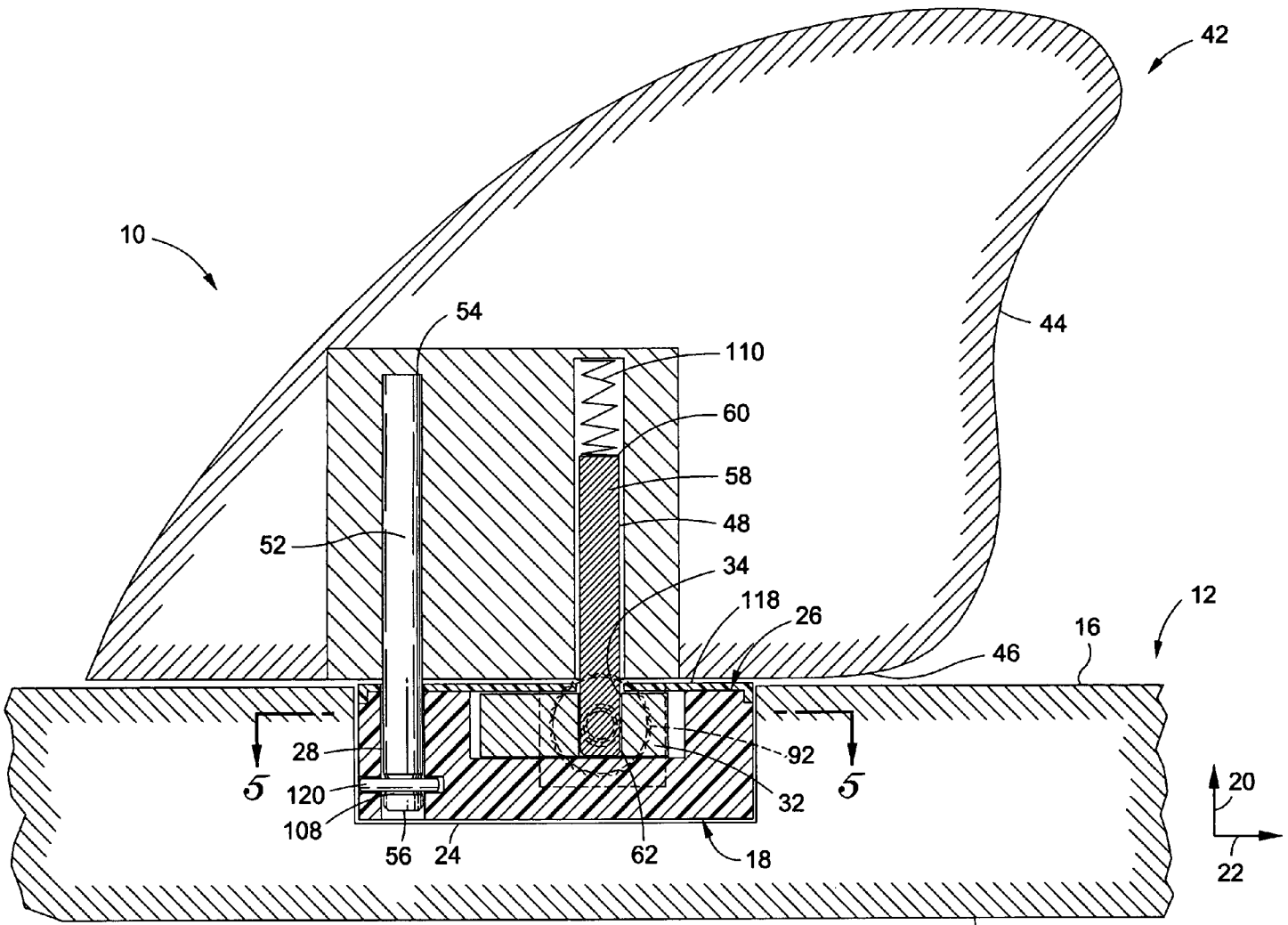
FIG. 4 is a cross-section of the surfboard fin assembly, showing the insertion of the lock pin into the lock pin aperture of the insert bracket and the biased movement of the flex pin by the flex pin spring into the flex plug hole of the flex plug.

Referring to the cross-sectional view in FIG. 4, an embodiment of the surfboard fin assembly 10 depicts the biased flex pin spring 110 disposed in the distal end of the flex pin channel 48. The flex pin first end 60 is positioned adjacent to the flex pin spring 110. The flex pin second end 62 is shown disposed into the flex plug hole 34 of the flex plug 32.

Still referring to FIG. 4, an embodiment of the surfboard fin assembly 10 is shown with the fixed lock pin 52 disposed in the lock pin aperture 28. In this embodiment, the lock pin second end 56 has a lock pin cam head 108 for rotatably engaging a lock pin plate 120 mounted to the distal end of the lock pin aperture 28. In this embodiment of the surfboard fin assembly 10, the surfboard fin 42 is mounted to the insert bracket 18 by first inserting the fixed lock pin second end 56 into the lock pin aperture 28 along the lock pin axis 51, and then rotating the lock pin second end 56 to enable the lock pin plate 120 to fit into the beveled lock pin cam head 108 at the distal end of the lock pin aperture 28. After the lock pin plate 120 and lock pin cam head 108 are mated, the biased flex pin 58 may then be released into the flex plug hole 34 by operation of the biasing action of the flex pin spring 110.

FIGS. 1-3 similarly show the beveled lock pin cam head 108 on the lock pin second end 56 in this embodiment of the surfboard fin assembly 10.

Figure 5:
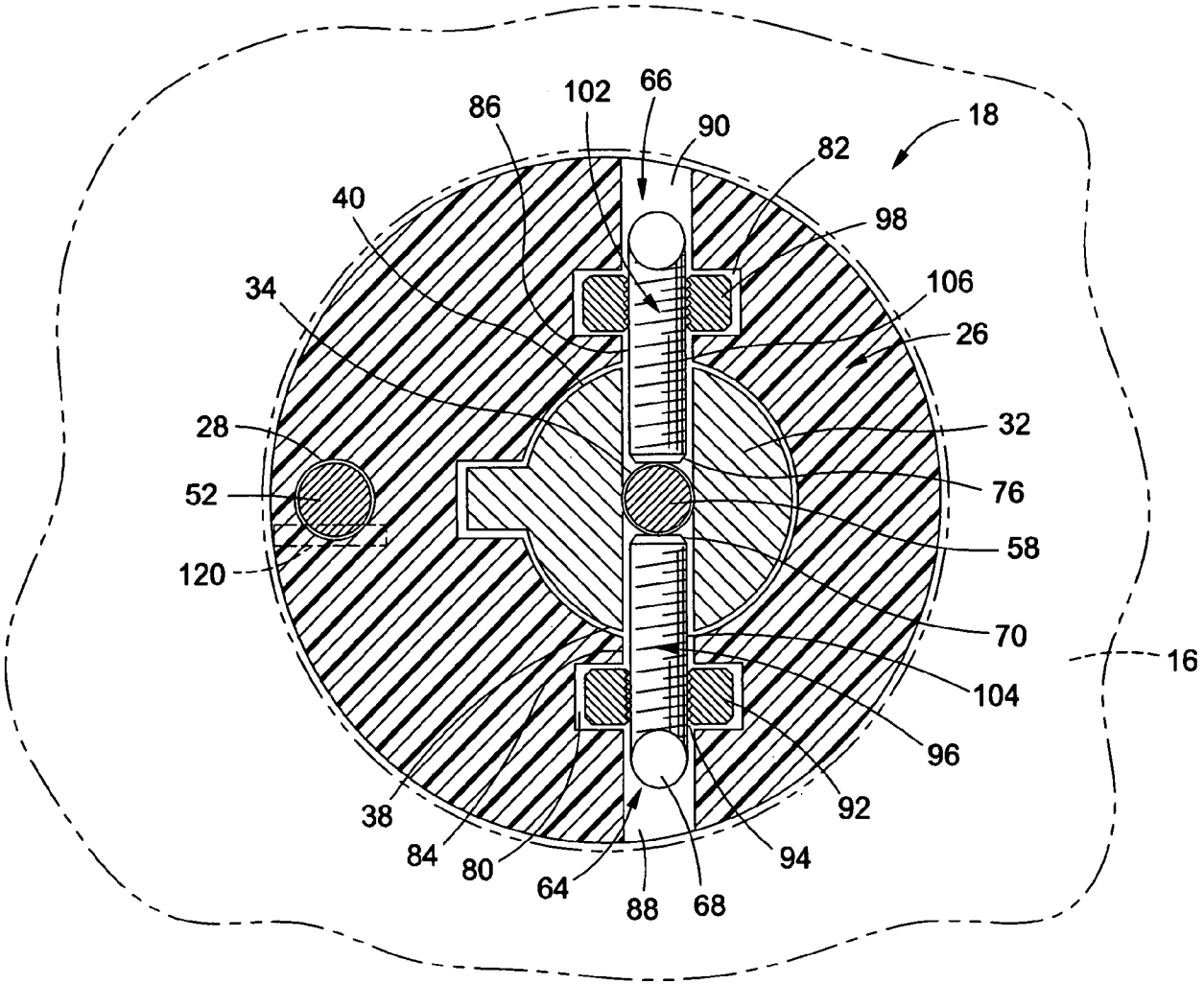
FIG. 5 is an exploded top view of the compression of the first compression pin along a first compression pin axis through the first flex plug surface aperture and the second compression pin along a second compression pin axis through the second flex plug surface aperture to control the amount of pivot of the flex pin positioned along a longitudinal flex pin axis in the flex plug hole.

Referring now to a top view of the surfboard fin assembly 10 in FIG. 5, the lock pin 52 and flex pin 58 are shown disposed in the lock pin aperture 28 and flex plug hole 34, respectively, along horizontal axes. The first compression pin 64 is shown disposed through the first thumbwheel channel 84 and the first flex plug surface aperture 104 of the flex plug 32. Likewise, the second compression pin 66 is shown disposed through the second thumbwheel channel 86 and the second flex plug surface aperture 106. Both the first compression pin second end 70 and the second compression pin second end 76 are shown compressing along lateral axes the flex plug 32 and the flex pin 58. As discussed above, this configuration uniquely enables the surfboard fin assembly 10 to adjust the pivot of the surfboard fin 42 with precision within a narrow range of motion, given the close proximity of the first compression pin 64 and the second compression pin 66 to the flex pin 58. Furthermore, this configuration of the surfboard fin assembly 10 allows the customized adjustment of lateral compression forces on each side of the flex pin 58, thereby allowing more or less resistance to water forces on one or both sides of the fin blade 44, depending on the amount of pivot desired in the surfboard fin 42. The first thumbwheel 92 and the second thumbwheel 98 being positioned proximate to the flex pin 58 on the insert bracket 18, as well as the interaction of the threaded first thumbwheel aperture 94 and the threaded second thumbwheel aperture with the threaded first compression pin stem 96 and the threaded second compression pin stem 102 makes the process of adjusting the pivot on the surfboard fin assembly 10 efficient and readily accessible.

Figure 6:
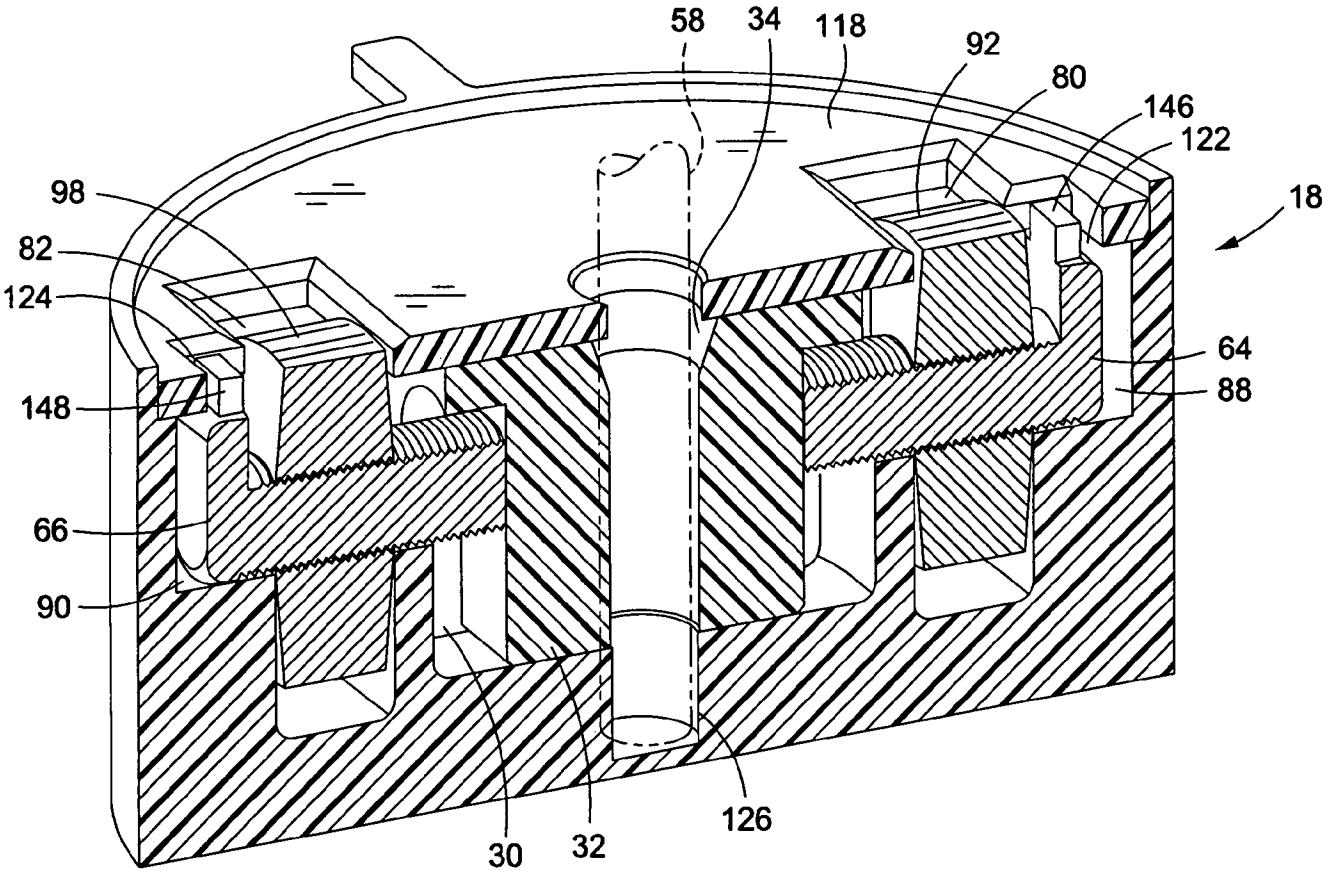
FIG. 6 is a cross-section of an embodiment of the surfboard fin assembly showing the insert bracket, the compression pins, and the flex pin disposed through the flex pin aperture for locking the movement of the surfboard fin.

Referring now to FIG. 6, the cross-section of an embodiment of the surfboard fin assembly 10 is depicted. In particular, the bottom of the flex plug cavity 30 is shown to have a flex pin aperture 126 whose diameter may be slightly smaller than that of the flex pin 58, thereby enabling a tight fit between the flex pin 58 and the flex pin aperture 126. The flex pin 58 may be inserted through the length of the flex plug hole 34 of the flex plug 32 along the longitudinal flex pin axis 50. The flex pin second end 62 may then be further extendable into the flex pin aperture 126. Therefore, to the extent no lateral pivot is desired in the fin blade 44 of the surfboard fin 42, the flex pin 58 may be slidably engaged with the insert bracket 18 to a depth that penetrates the flex plug aperture 126, thereby locking the flex pin 58 to the insert bracket 18.

Figure 8:
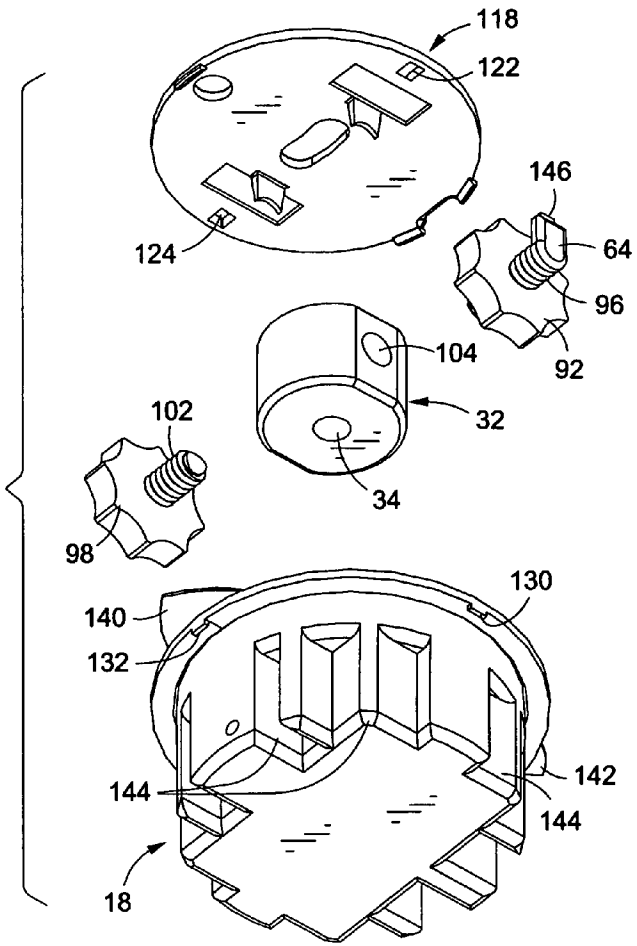
FIG. 8 is a bottom view of an embodiment of the surfboard fin assembly, with the insert bracket having ribs, a flange, and indicator windows on the insert bracket seal positioned adjacent to the thumbwheel grooves.
Figure 7:
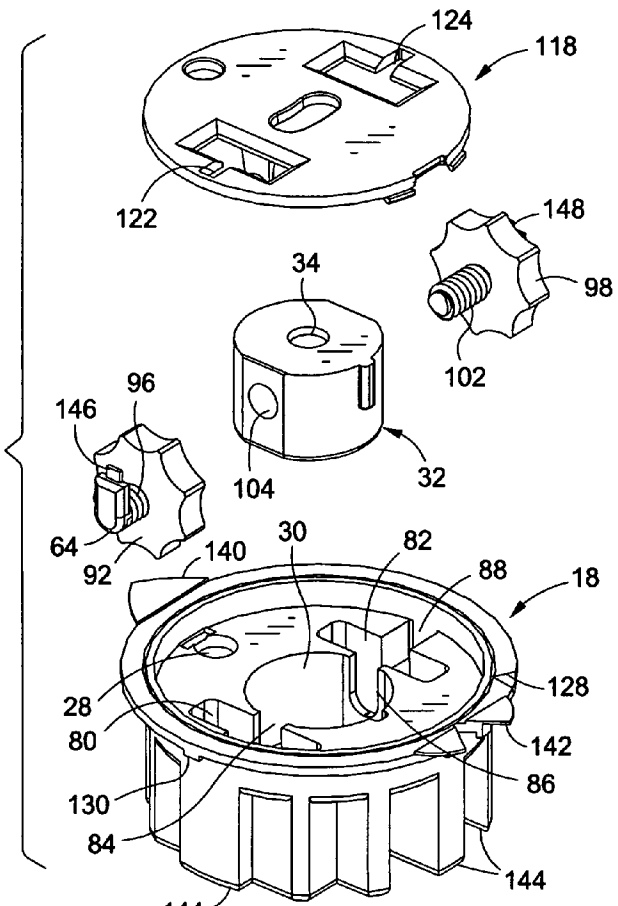
FIG. 7 is a perspective view of an embodiment of the surfboard fin assembly, with the insert bracket having ribs, a flange, and indicator windows on the insert bracket seal connected to the thumbwheel grooves.

In another embodiment of the surfboard fin assembly 10 depicted in FIGS. 1-3, 7 and 8, the insert bracket 18 has an insert bracket seal 118 having various openings for the first thumbwheel groove 80, the second thumbwheel groove 82, the flex plug 32, and the lock pin aperture 28. As shown in FIGS. 7 and 8, the insert bracket seal 118 may further have a first indicator window 122 showing the relative position of the first compression pin 64 along the first compression pin channel 88. Similarly, the insert bracket seal 118 may also have a second indicator window 124 to view the position of the second compression pin 66 along the second compression pin channel 90. The lateral movements of a first compression pin notch 146 on the first compression pin 64 and a second compression pin notch 148 on the second compression pin 66 may be viewed through the first indicator window 122 and the second indictor window 124, respectively, as the positions of the first compression pin 64 and the second compression pin 66 are adjusted by the first thumbwheel 92 and the second thumbwheel 98. In FIG. 7, the first indicator window 122 and the second indictor window 124 are shown conjoined with the opening for the first thumbwheel groove 80 and the second thumbwheel groove 82, respectively. However, in another embodiment shown in FIG. 8, the first indicator window 122 and the second indicator window 124 may be separately positioned on the insert bracket seal 118, detached from the opening for the first thumbwheel groove 80 and the second thumbwheel groove 82.

Still referring to FIGS. 7 and 8, the lower surface of the insert bracket 18 may be ribbed with insert bracket ribs 144. This configuration enables the insert bracket 18 to be lightweight due to the use of less material. Furthermore, this configuration enables the achievement of a stronger bond between the insert bracket 18 and a bonding substance such as resin with the insert bracket 18 mounted to the bottom surface 16 of the surfboard 12. Also shown in FIGS. 7 and 8 is an embodiment of the surfboard fin assembly 10 with a flange 128 on the insert bracket 18 having a flange nose 140, a flange tail 142, and flange tabs 130-138 operative to enable the insert bracket 18 to be positioned flush with and level to the bottom surface 16 of the surfboard 12 as the resin used to mount the insert bracket 18 hardens. Once the resin has hardened, the flange 128 may be readily removed from the top of the insert bracket 18.

Although the surfboard fin assemblies 10 depicted in FIGS. 1-8 show the application of a single insert bracket 18 with a single surfboard fin 42 on a surfboard 12, it is contemplated that a surfboard 12 may have a plurality of surfboard fins 42 mounted to its bottom surface 16. Therefore, it is further contemplated that each surfboard fin 42 on a surfboard 12 may be equipped with the surfboard fin assembly 10 disclosed by the present invention.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pivotal surfboard fin assembly for use with a surfboard, the surfboard having a top surface and a bottom surface, the assembly comprising:

an insert bracket defining a longitudinal bracket axis and a lateral bracket axis disposed perpendicular to the longitudinal bracket axis, the insert bracket having a board face mountable to the bottom surface of the surfboard and a bracket face opposite the board face, the bracket face having a lock pin aperture defining a generally longitudinal lock pin axis and a flex plug cavity;

an elastomeric flex plug having a flex plug hole defining a generally longitudinal flex plug axis, a first flex plug surface and an opposing second flex plug surface, the flex plug disposed in the flex plug cavity;

a surfboard fin having a fin blade, a mounting edge, a flex pin channel defining a generally longitudinal flex pin axis extending from the interior of the fin blade to the mounting edge, a fixed lock pin having a lock pin first end mountable to the surfboard fin at the mounting edge and a lock pin second end sized and configured to be rotatably and slidably disposable into the lock pin aperture, the surfboard fin further having a biased flex pin proximate to the lock pin with a flex pin first end sized and configured to be slidably disposable into the flex pin channel, the flex pin further having a flex pin second end sized and configured to be slidably disposable into the flex plug hole with the insertion of the lock pin second end into the lock pin aperture, thereby enabling the fin blade to pivot on the bottom surface of the surfboard; and a first compression pin and a second compression pin, the first compression pin having a first compression pin first end engaged with the insert bracket and a first compression pin second end sized and configured to compress the first flex plug surface along a generally lateral first compression pin axis with the flex pin second end disposed in the flex plug hole, the first compression pin axis being generally orthogonal to the flex plug, the second compression pin having a second compression pin first end engaged with the insert bracket and a second compression pin second end sized and configured to compress the second flex plug surface along a generally lateral second compression pin axis with the flex pin second end disposed in the flex plug hole, the second compression pin axis being generally orthogonal to the flex plug.

2. The assembly as claimed in claim 1, wherein the insert bracket is round.

3. The assembly as claimed in claim 1, wherein the flex plug is made of rubber.

4. The assembly as claimed in claim 1, wherein the flex plug is cylindrical.

5. The assembly as claimed in claim 1, wherein the flex plug is polygonal.

6. The assembly as claimed in claim 1, wherein the bracket face of the insert bracket includes a first thumbwheel groove and a second thumbwheel groove generally opposing the first thumbwheel groove, with the flex plug cavity disposed proximate to and in communication with the first thumbwheel groove through a first thumbwheel channel, the flex plug cavity further disposed proximate to and in communication with the second thumbwheel groove through a second thumbwheel channel, the first flex plug surface facing the first thumbwheel channel and the second flex plug surface facing the second thumbwheel channel, the bracket face further including a first compression pin channel extending to and in communication with the first thumbwheel groove, the first compression pin first end disposed in the first compression channel, the bracket face further including a second compression pin channel extending to and in communication with the second thumbwheel groove, the second compression pin first end disposed in the second compression channel.

7. The assembly as claimed in claim 6 further includes a first thumbwheel disposed in the first thumbwheel groove, the first thumbwheel having a threaded first thumbwheel aperture, the assembly further including a threaded first compression pin stem between the first compression pin first end and the first compression pin second end disposed through the first thumbwheel aperture, the first thumbwheel upon rotation operative to laterally move the first compression pin through the first thumbwheel channel with the first compression pin second end compressing the first flex plug surface along the first compression pin axis, thereby adjusting the pivot of the surfboard fin.

8. The assembly as claimed in claim 7 further includes a second thumbwheel disposed in the second thumbwheel groove, the second thumbwheel having a threaded second thumbwheel aperture, the assembly further including a threaded second compression pin stem between the second compression pin first end and the second compression pin second end disposed through the second thumbwheel aperture, the second thumbwheel upon rotation operative to laterally move the second compression pin through the second thumbwheel channel with the second compression pin second end compressing the second flex plug surface along the second compression pin axis, thereby adjusting the pivot of the surfboard fin.

9. The assembly as claimed in claim 8 further includes a first flex plug surface aperture on the first flex plug surface and an opposing second flex plug surface aperture on the second flex plug surface, with the first compression pin second end movable through the first flex plug surface aperture by rotation of the first thumbwheel operative to compress the flex plug and the flex pin along the first compression pin axis, and the second compression pin second end disposable through the second flex plug surface aperture by rotation of the second thumbwheel operative to compress the flex plug and the flex pin along the second compression pin axis, thereby adjusting the pivot of the surfboard fin.

10. The assembly as claimed in claim 1 further includes a flex pin aperture on the flex plug cavity, the flex pin being sized and configured to be slidably engageable with the flex pin aperture to lock the flex pin to the insert bracket, thereby enabling the fin blade to not pivot on the bottom surface of the surfboard.

11. The assembly as claimed in claim 1, wherein the first compression pin first end is beveled.

12. The assembly as claimed in claim 1, wherein the second compression pin first end is beveled.

13. The assembly as claimed in claim 1, wherein the lock pin second end has a lock pin cam head for rotatably engaging a lock pin plate mounted to the distal end of the lock pin aperture.

14. The assembly as claimed in claim 1 further includes a biased flex pin spring disposed in the distal end of the flex pin channel adjacent to the flex pin first end, the flex pin spring operative to release the flex pin second end along the flex plug axis into the flex plug hole with the insertion of the lock pin second end into the lock pin aperture.

15. The assembly as claimed in claim 1 further includes a flex pin lever on the flex pin operative to extend the flex pin second end along the flex plug axis into the flex plug hole, the flex pin lever extendable through a lever aperture proximate to the flex pin channel on the fin blade, the lever aperture having a lever notch operative to position the flex pin lever, with the flex pin lever above the lever notch with the flex pin retracted into the flex pin channel and the flex pin lever below the lever notch with the flex pin extended into the flex plug hole.

16. The assembly as claimed in claim 1 further includes an insert bracket seal operative to cover the insert bracket.

* * * * *